United States Patent [19]

Fabritz

[11] 4,058,102

[45] Nov. 15, 1977

[54] FUEL ECONOMIZER FOR CABURETED INTERNAL COMBUSTION ENGINES

[76] Inventor: Robert E. Fabritz, 3200 Shepherd St., Mount Ranier, Md. 20822

[21] Appl. No.: 683,630

[22] Filed: May 5, 1976

[51] Int. Cl.[2] ..... F02M 29/00

[52] U.S. Cl. ..... 123/141; 261/78 R; 48/180 R

[58] Field of Search ..... 123/141, DIG. 2; 261/78 R; 48/180 R, 180 M, 180 B

[56] References Cited

U.S. PATENT DOCUMENTS

| | | | |
|---|---|---|---|
| 1,031,753 | 7/1912 | Westaway | 123/141 |
| 1,767,305 | 6/1930 | Musall | 48/180 M |
| 2,027,480 | 1/1936 | Higley | 123/141 |
| 2,251,999 | 8/1941 | Greco | 48/180 R X |
| 3,112,741 | 12/1963 | Guanaschelli | 123/141 UX |
| 3,467,072 | 9/1969 | Toesca | 123/141 |
| 3,753,304 | 8/1973 | Hughes | 123/141 X |

FOREIGN PATENT DOCUMENTS

| | | | |
|---|---|---|---|
| 685,554 | 7/1930 | France | 123/141 |

*Primary Examiner*—Ronald H. Lazarus
*Assistant Examiner*—Ira S. Lazarus
*Attorney, Agent, or Firm*—Shoemaker and Mattare, Ltd.

[57] ABSTRACT

A fuel economizer for carbureted internal combustion engines comprises a tubular body having open inlet and outlet ends and adapted to be positioned and supported between the carburetor and the intake manifold of the engine. An annular, liquid collecting chamber is defined in the body between the ends thereof for collecting liquid fuel exiting from the carburetor and includes air passages for circulation and deflection of air over the collected liquid fuel to effect atomization of the fuel before it is supplied to the intake manifold. A combined valving member and air/fuel deflector plate is movably supported by the body at the outlet end thereof and is yieldably biased toward the outlet end into a closed position relative thereto. The valving member also has a liquid fuel collecting chamber to collect any liquid fuel exiting the outlet end of the body, whereby air flowing through the body contacts the collected liquid fuel to effect atomization of the same, and the valving member opens and closes in general correspondence with the carburetor throttle valve, to thus effect more efficient combustion of the fuel and thereby increase the economy of operation of the engine.

12 Claims, 6 Drawing Figures

FUEL ECONOMIZER FOR CABURETED INTERNAL COMBUSTION ENGINES

BACKGROUND OF THE INVENTION

This invention relates in general to fuel economizers for carbureted internal combustion engines, and in particular, relates to such a fuel economizer which includes fuel collecting means to collect liquid fuel exiting the carburetor of the engine and has means for contacting the collected fuel with air to effect thorough atomization of the liquid fuel, whereby the fuel supplied to the intake manifold and cylinders of the engine is thoroughly atomized.

One of the basic objectives in carburetor and/or intake manifold design is to provide for thorough atomization of liquid fuel to thus prevent liquid fuel from reaching the cylinders of the engine. Liquid fuel reaching the cylinders of an internal combustion engine is not only detrimental from the standpoint of reduced fuel economy, but liquid fuel in the cylinders also washes lubricant from the cylinder walls, resulting in increased wear of the engine components.

Many attempts have been made in the prior art to devise means for increasing the atomization of liquid fuel to thereby improve the economy of operation of internal combustion engines, and some such devices are disclosed in U.S. Pat. Nos. 1,658,547, 1,814,143, 2,251,999, 2,477,732 and 3,923,027. As can be seen from these prior art patents, previous attempts to solve the above-noted problems range from movable valving members to stationary turbulence producing means. While some of these prior art devices have met with various degrees of success, they all have one or more problems seriously limiting their applicability to internal combustion engines. For example, some of the devices require modification of the carburetor and/or intake manifold for their use, and other devices do not significantly increase atomization of liquid fuel, but merely vary the richness of the air/fuel mixture being supplied to the engine.

With conventionally carbureted engines in use today, a substantial amount of liquid fuel is not atomized by the carburetor and collects in puddles or wet films on the walls of the intake manifold, and in extreme instances is supplied as liquid fuel to the cylinders of the engine. This, of course, results in an excessively rich air/fuel mixture, with the consequence that complete combustion of the fuel is not obtained and the exhaust from the engine thereby contains unburned hydrocarbons which pollute the atmosphere. In order to overcome this, most manufacturers today use various types of exhaust recycling means or catalytic converters or other devices for removing pollutants from the exhaust prior to its being discharged to atmosphere. These devices are expensive and require skilled maintenance, and in some cases are not adequate in operation. Still further, most of these devices seriously hinder the performance of automobile engines.

OBJECTS OF THE INVENTION

It is, therefore, an object of the present invention to provide a fuel economizer for carbureted internal combustion engines, wherein the economizer can be placed between the carburetor and intake manifold of the engine without requiring special tools and the like and without requiring modification to either the carburetor or intake manifold.

Another object of the invention is to provide a fuel economizer for internal combustion engines wherein the economizer includes liquid fuel collecting means to collect liquid fuel supplied by the carburetor to the intake manifold of the engine and air passage means for flowing air over the collected liquid fuel to atomize the same and thus improve the economy of operation of the engine.

A further object of the invention is to provide an economical, easily positioned and removed fuel economizer for carbureted internal combustion engines, wherein the economizer includes a tubular body positionable in the intake manifold in registry with the carburetor, and wherein the economizer is a simple drop-in unit which requires no modification of the intake manifold or carburetor and does not require any separate fasteners and which includes means for effecting atomization of liquid fuel supplied to the intake manifold by the carburetor.

A still further object of the invention is to provide a fuel economizer for carbureted internal combustion engines which does not significantly affect the preset air/fuel ratio desired to be obtained by the carburetor, and which can be placed on the engine of a vehicle at the time of manufacture of the vehicle, or which can be added to the engine at a later time, as desired.

DETAILED DESCRIPTION OF THE INVENTION

Figure 1:
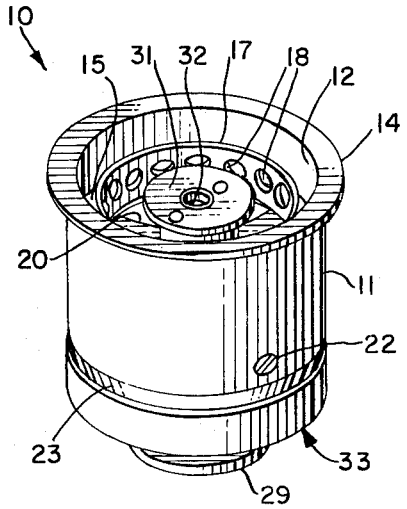
FIG. 1 is a top perspective view of a fuel economizer according to the invention.
Figure 2:
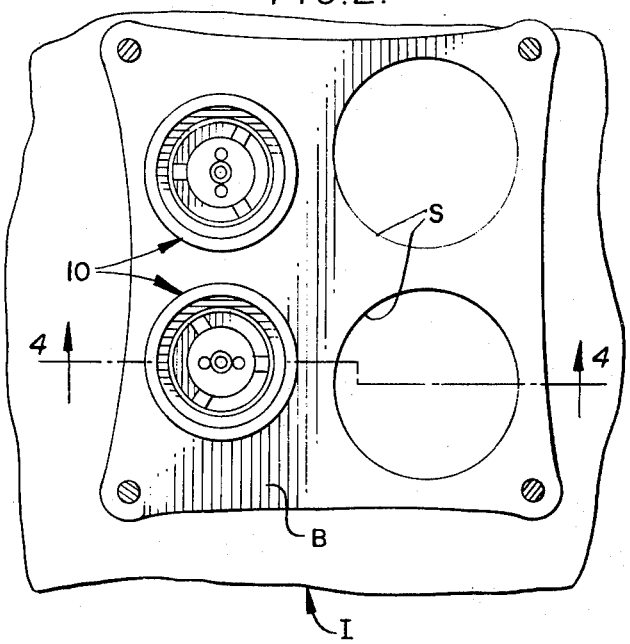
FIG. 2 is a plan view of a portion of an intake manifold of a carbureted internal combustion engine, showing a pair of fuel economizers in accordance with the invention inserted into the primary openings in the carburetor attaching base or portion of the intake manifold.
Figure 3:
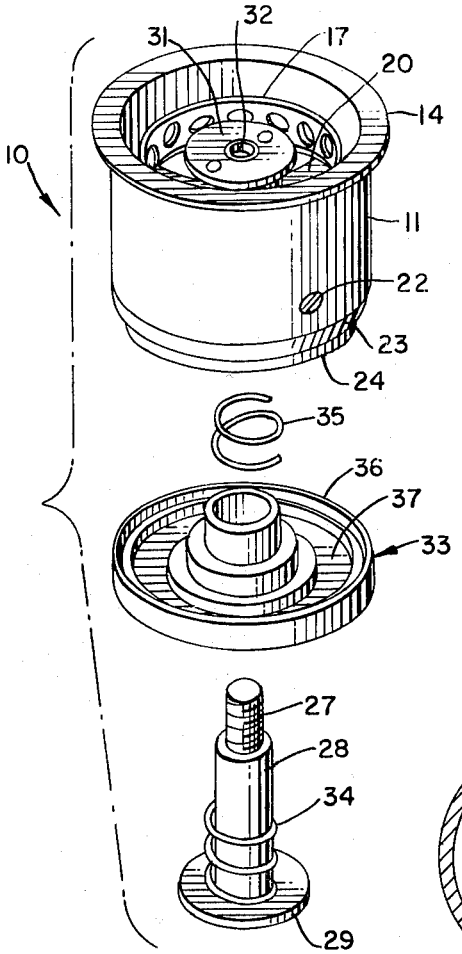
FIG. 3 is an exploded, perspective view of the economizer of FIG. 1.

In the drawings, wherein like reference numerals indicate like parts throughout the several views, a fuel economizer is indicated generally at 10 in FIG. 1 and comprises a tubular body or cylinder 11 having an open inlet end 12 and an open outlet end 13. An annular, radially outwardly extending flange 14 is formed integral with the open end of the tubular body or cylinder 11 for engaging the upper surface of a carburetor mounting base or flange B on the intake manifold I. An annular, radially inwardly directed, axially upwardly facing shoulder on ledge 15 is formed in the inner surface of the side wall of tubular body 11 approximately midway between the open upper and lower ends thereof, and the inner diameter of the tubular body below the shoulder 15 is enlarged to define a radially inwardly directed annular flange 16.

An upstanding, cylindrical, perforated wall 17 has a plurality of openings 18 formed therethrough and has an annular, radially outwardly directed flange 19 on the bottom end thereof engaged upwardly against the bottom side of flange 16 on the body 11. The perforated wall 17 is thus maintained in coaxial, radially inwardly spaced relationship to the inner surface of cylindrical body 11, defining a fluid collecting chamber therewith, whereby liquid fuel leaving the carburetor is collected on the ledge or shoulder 15 between wall 17 and body 11, such that air flowing from the carburetor flows into the space between the two walls and into contacting relationship with the fuel and thence outwardly through the openings 18 to atomize the fuel prior to the fuel being conveyed to the engine.

A spider member 20 is engaged against the bottom of flange 19 on the upstanding, perforated wall 17, and a cylindrical retaining sleeve 21 is secured in the enlarged diameter lower end portion of the body 11 by means of screws or the like 22, and has its upper end engaged against the underside of the outer peripheral ends of spider 20 to thus maintain the spider and the upstanding perforated wall 17 in position within the cylindrical wall 11.

Figure 4:
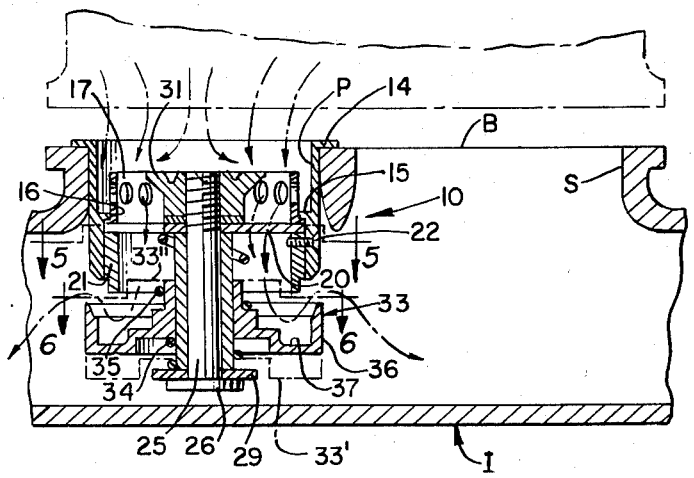
FIG. 4 is a view in section taken along line 4—4 in FIG. 2, showing the mode of operation of the economizer of the invention.
Figure 5:
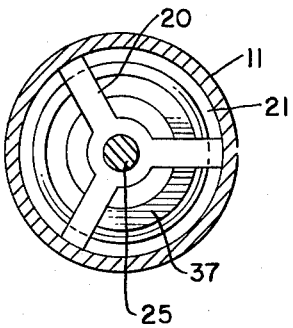
FIG. 5 is a view in section taken along line 5—5 in FIG. 4.
Figure 6:
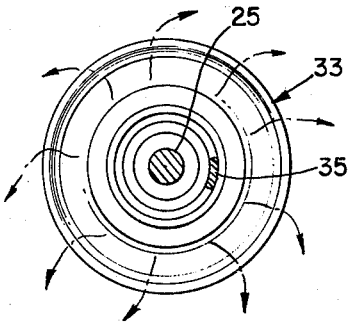
FIG. 6 is a view in section taken along line 6—6 in FIG. 4.

As seen in FIG. 4, a lower outer end surface of body 11 is tapered at 23 and the lower end 24 of retaining sleeve 21 projects downwardly below the open lower end of body 11.

An elongate retaining bolt or rod 25 has a diametrically enlarged head 26 on a lower end thereof and an externally threaded upper end 27. A tubular spacer sleeve and bushing 28 surrounds the retaining bolt 25 and is engaged at its lower end against a washer 29 received on the retaining bolt against the headed end 26 thereof and is engaged at its upper end against the underside of spider 20. The threaded end 27 of retaining bolt 25 extends upwardly through an opening in the center of the spider, and a lock washer 30 and retaining nut 31 are engaged on the upper end of retaining bolt 25 to securely hold the parts in assembled relationship, as seen in FIG. 4, with the washer 29 maintained in predetermined spaced relationship below the bottom end of the tubular body. If desired, the upper end of retaining bolt 25 may be upset or deformed as at 32 in order to secure the retaining nut 31 in tightened position to thus insure that the economizer does not develop loose parts which may fall into the intake manifold and be drawn into a cylinder of the engine.

A combination air/fuel deflector and valving member 33 is reciprocable on the combined spacer and bushing 28. A first coil spring 34 is engaged between the washer 29 and the underside of deflector means or valve 33 to urge the valve upwardly toward closing relationship relative to the lower end of body 11. A second spring 35 is engaged between the underside of spider 20 and the top of valve 33 to prevent the valve from chattering or oscillating between partially open and fully closed position when the engine is idling or under similar conditions. In other words, the spring 35 has a damping effect on the action of the valve 33, which insures smooth, quiet operation during all engine operating conditions.

As seen in the drawings, the combined air/fuel deflector and valving member 33 has an upstanding, peripheral wall 36 thereon, which defines an annular fuel collecting chamber 37, such that any liquid fuel not atomized by the carburetor and preceding portions of the economizer is collected therein, with the result that air flows thereover in contacting relationship thereto, as indicated by the arrows, to atomize the liquid fuel.

As seen in FIG. 4, the valve is in an intermediate position, as under part throttle conditions, for example, and has a full open position as seen in phantom line at 33', and a substantially closed position as seen in phantom line at 33''.

It should be noted that the retaining nut and upper end of the retaining bolt or rod 25 are spaced below the upper end of cylindrical body 11 a distance sufficient to provide clearance for the throttle valve in a carburetor C used therewith. With regard to the retaining nut 31, it should be noted that the underside thereof is tapered or cut away to provide clearance to thus obtain adequate air flow therepast.

Further, the various components of the economizer of the invention may be made of any suitable material, such as aluminum, steel or the like, and the combined spacer sleeve and bushing 28 may be made of brass or other suitable material for increased longevity and wear.

Additionally, it should be noted that the perforated wall 17 could have slots formed therein, extending downwardly from the upper edge thereof, rather than the holes or openings 18, if desired. This arrangement may simplify manufacture of the device, for example.

Moreover, rivets could be used rather than the screws 22 to secure the retaining sleeve 21 in place, or for that matter, any other suitable fastening means could be used.

As an alternate to the above described structure, the perforated wall, spider and retaining means could be assembled from the top end of the economizer and seated against the upper surface of flange 16. Further, either one of the fuel collecting means could be eliminated if deemed desirable or necessary. For example, if clearance of the carburetor throttle valve is a problem, or if a less expensive device is desired, the perforated wall and its function could be eliminated. Alternatively, if the fuel collecting means on the deflector 33 is not considered necessary, the upstanding wall 36 could be eliminated.

In use, it is necessary only to remove the carburetor from the intake manifold and drop the economizer into the intake manifold openings which register with the primary throttle bores and then reposition the carburetor. No special tools are required, nor are any separate fasteners required for the economizer.

For applications using a one-barrel carburetor, one economizer is used; for applications having two-barrel carburetors, two units are used; and for applications having four-barrel carburetors, two units or economizers are used in the primary bores only. The only adjustment required may be to reset the idle speed on the carburetor to obtain the same rpm as obtained prior to insertion of the economizer of the invention. No other modifications or adjustments are necessary.

An economizer in accordance with the invention has been constructed and used, and an actual increase in miles per gallon of nearly 40% was obtained, with no significant change in the performance or operating characteristics of the vehicle in which the economizer are used. It is suspected that the exhaust emissions may be substantially improved by use of the invention, but tests have not been conducted to date, so this possible advantage of the invention has not been confirmed.

In operation, the combined deflector and valve 33 assumes a nearly closed position under idle conditions, since very little flow of air and fuel is required to keep the engine running. However, as the throttle opening is increased and the engine speed increases, additional amounts of air and fuel are required, and the increased flow causes the combined deflector and valve 33 to move toward an open position against the bias of spring 34, thus enabling the proper amount of air and fuel to be supplied to the engine, but at the same time effecting thorough atomization of the fuel to prevent excessively rich mixtures or puddling of liquid fuel in the intake manifold.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A fuel economizer for internal combustion engines having an intake manifold and a carburetor thereon, comprises: a tubular body having an open inlet end and an open outlet end and means on the body for supporting the body in an intake manifold in aligned registry with a carburetor, whereby air and fuel leaving the carburetor will pass through the economizer; means on the body defining trough-like liquid fuel collecting means to collect liquid fuel leaving the carburetor; said liquid fuel collecting means having air passage means associated therewith for directing flow of air over collected fuel therein in contacting relationship therewith to atomize the liquid fuel; air/fuel deflector means movably carried by the body at the outlet end thereof in the path of air and fuel flowing through the outlet end of the body to promote turbulence in the air and fuel; and means yieldably biasing said deflector means toward closing relationship relative to the body, whereby the deflector means is moved toward open position in response to vacuum and increased flow in an intake manifold and is moved toward closed position by said biasing means under conditions of decreased vacuum and flow, said deflector means thus opening and closing in response to engine demand, and the economizer thus effecting thorough atomization of fuel and more efficient fuel combustion and consequently increasing the fuel economy of an engine.

2. A fuel economizer as in claim 1, wherein said deflector means includes second liquid fuel collecting means for collecting liquid fuel not atomized in the body of the economizer, whereby said liquid fuel is contacted with air and atomized prior to being supplied to an engine.

3. A fuel economizer as in claim 1, wherein said means for supporting the body in the intake manifold comprises a radially outwardly directed flange on the inlet end of the body, said flange engageable with an upper surface of an intake manifold to suspend the economizer in the intake manifold.

4. A fuel economizer as in claim 1, wherein second yieldable means is engaged with the deflector means to urge the deflector means toward an open position relative to the body, to thus damp movement of the deflector means under idle conditions of an engine with which the economizer is associated, to thus prevent undesired oscillatory movement of the deflector means.

5. A fuel economizer as in claim 3, wherein said deflector means includes second liquid fuel collecting means for collecting liquid fuel not atomized in the body of the economizer, whereby said liquid fuel is contacted with air and atomized prior to being supplied to an engine.

6. A fuel economizer as in claim 5, wherein second yieldable means is engaged with the deflector means to urge the deflector means away from the open outlet end of the body, to thus damp movement of the deflector means under idle conditions of an engine with which the economizer is associated, to thus prevent undesired oscillatory movement of the deflector means.

7. A fuel economizer as in claim 6, wherein a radially inwardly directed annular shoulder is formed in the body spaced between the inlet and outlet ends thereof and facing axially toward the inlet end, and an upstanding, perforated, cylindrical wall is supported in the body in coaxial radially inwardly spaced relation to an inner surface of the inlet end of the body, said perforated wall extending toward the inlet end of the body from the shoulder and defining with the shoulder and body said first liquid fuel collecting means.

8. A fuel economizer as in claim 7, wherein said deflector means includes a bottom wall and an upstanding, annular, cylindrical wall on the periphery thereof, said bottom wall and upstanding peripheral wall defining said second liquid fuel collecting means, whereby air flowing through the economizer contacts the collected fuel and is diverted upwardly and outwardly over the upstanding wall, thus including turbulence in the air and fuel and effecting atomization of the fuel.

9. A fuel economizer as in claim 3, wherein a radially inwardly directed, annular shoulder is formed in the body spaced between the inlet and outlet ends thereof and facing axially toward the inlet end, an upstanding, perforated, cylindrical wall is supported in the body in coaxial radially inwardly spaced relation to an inner surface of the inlet end of the body, said perforated wall extending toward the inlet end of the body from the shoulder and defining with the shoulder and body said liquid fuel collecting means, a spider member secured in the body below the perforated wall, a retaining sleeve engaged against the body at the outlet end thereof and extending coaxially therewith into engagement with the spider member at the periphery of the spider member, an elongate, headed retainer bolt extended coaxially through the outlet end of the body and having a threaded end projecting through the spider member toward the inlet end of the body, a spacer sleeve around the bolt engaged at one end with the headed end and engaged at the other end thereof with the spider member, said deflector means axially slidable on the spacer sleeve toward and away from the outlet end of the body, and retaining nut means on the threaded end of the bolt above the spider member holding the parts in assembled relationship.

10. A fuel economizer as in claim 9, wherein a first coil spring means is engaged between the deflector means and the headed end of the bolt for urging the deflector means into closing position relative to the outlet end of the body, and a second coil spring means is engaged between the deflector means and the spider member for damping closing movement of the deflector means.

11. A fuel economizer for internal combustion engines having an intake manifold and a carburetor thereon, comprises: a tubular body having an open inlet end and an open outlet end and means on the body for supporting the body in an intake manifold in aligned registry with a carburetor, whereby air and fuel flowing from a carburetor to an associated intake manifold passes through the economizer; means in the body defining trough-like liquid fuel collecting means to collect liquid fuel leaving the carburetor; said liquid fuel collecting means having means associated therewith for enabling flow of air over collected fuel therein in contacting relationship therewith to atomize the liquid fuel; air/fuel deflector means movably carried by the body at the outlet end thereof in the path of air and fuel exiting the outlet end of the body to promote turbulence in the air and fuel; and means yieldably biasing said deflector means toward closing relationship relative to the open outlet end, whereby the deflector means is moved toward open position in response to vacuum and increased flow in an intake manifold and is moved toward closed position by said biasing means under conditions of decreased vacuum and flow, said deflector means thus opening and closing in response to engine demand, and the economizer thus effecting thorough atomization of fuel and more efficient fuel combustion and consequently increasing the fuel economy of the engine.

12. A fuel economizer for internal combustion engines having an intake manifold and a carburetor thereon, comprise: a tubular body having an open inlet end and an open outlet end and means on the body for supporting the body in an intake manifold in aligned registry with an associated carburetor, whereby air and fuel from a carburetor passes through the economizer when in use; air/fuel deflector means movably carried by the body at the outlet end thereof in the path of air and fuel exiting the outlet end of the body to promote turbulence in the air and fuel; first resilient means yieldably biasing said deflector means toward closing relationship relative to the open outlet end; and second resilient means disposed between the deflector means and the body to urge the deflector means away from the open outlet end of the body, to thus damp movement of the deflector means under idle conditions of an engine with which the economizer is associated, to thus prevent undesired oscillatory movement of the deflector means, said deflector means being moved toward open position in response to vacuum and increased flow in an associated intake manifold and moved toward closed position by said first resilient means under conditions of decreased vacuum and flow, said deflector means thus opening and closing in response to engine demand, and the economizer thus effecting thorough atomization of fuel and more efficient fuel combustion and consequently increasing the fuel economy of an engine.

* * * * *

UNITED STATES PATENT OFFICE

CERTIFICATE OF CORRECTION

PATENT NO. : 4,058,102

DATED : November 15, 1977

INVENTOR(S) : Robert E. Fabritz

It is certified that error appears in the above-identified patent and that said Letters Patent are hereby corrected as shown below:

Please correct the title of the patent to read:

FUEL ECONOMIZER FOR CARBURETED INTERNAL COMBUSTION ENGINES

Please correct the address of the patentee to read:

3200 Shepherd Street,
Mount Rainier, Maryland 20822

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*